United States Patent [19]

Benthimere

[11] 4,365,767

[45] Dec. 28, 1982

[54] APPARATUS FOR LAMINATING AND COILING INSULATION BLANKETS

[76] Inventor: Floyd D. Benthimere, c/o Heleron Corporation, 9055 Freeway Dr., Macedonia, Ohio 44056

[21] Appl. No.: 230,533

[22] Filed: Feb. 2, 1981

[51] Int. Cl.[3] ..... B65H 17/02; B65H 23/10

[52] U.S. Cl. ..... 242/67.1 R; 242/75.2

[58] Field of Search ..... 242/67.1 R, 67.2, 67.3 R, 242/65, 66, 75.2, 55.1

[56] References Cited

U.S. PATENT DOCUMENTS

| | | | |
|---|---|---|---|
| 2,927,742 | 3/1960 | Overman | 242/55.1 |
| 3,658,273 | 4/1972 | Chapuls | 242/67.1 |
| 3,808,771 | 5/1974 | Drelia | 53/118 |
| 3,979,245 | 9/1976 | Bondra | 156/184 |
| 4,114,530 | 9/1978 | Miller | 100/87 |

*Primary Examiner*—Edward J. McCarthy

*Attorney, Agent, or Firm*—Pearne, Gordon, Sessions, McCoy & Granger

[57] ABSTRACT

A tensioning and compression apparatus is disclosed for systems for laminating facing on insulation mats and for coiling the laminate. The system includes a powered roll around which the blanket is coiled and a tensioning and compression roll which engages the exterior surface with a force in a direction toward the powered roll which can be maintained at a constant level during any coiling operation or changed as a function of the diameter of the roll during the coiling operation. Force on the tension and compression roll is provided by a piston and cylinder actuator supplied with related positive pressures to both ends of the cylinder. The relationship between the two pressures determines the output force of the cylinder and the force applied by the tension and compression roll to the coil being formed. Separately adjustable control circuits are provided to supply the pressure to each end of the cylinder.

15 Claims, 5 Drawing Figures

APPARATUS FOR LAMINATING AND COILING INSULATION BLANKETS

BACKGROUND OF THE INVENTION

This invention relates generally to systems for laminating facing on insulation, and more particularly to a novel and improved tensioning apparatus for controlling the tension and compression in rolls of faced insulation blankets.

PRIOR ART

Insulation blankets are generally provided with a vapor barrier facing material which is laminated with adhesive to the surface of the insulation material such as a loose mat of glass fibers or the like.

Insulation blankets for metal buildings or the like are often produced in sizes, thicknesses, and lengths to fit a particular building. Such blankets are normally produced with laminating machines which apply adhesive to the facing sheet and bring the mat and facing together in a winding machine which winds the blanket for storage and shipment. An example of such a machine is illustrated in U.S. Pat. No. 3,979,245, assigned to the assignee of the present invention. Examples of additional prior art machines for winding strip material are illustrated in U.S. Pat. Nos. 2,927,742; 3,658,273; 3,808,771; and 4,114,530.

Since the winding is usually performed before the adhesive sets, the setting of the adhesive occurs while the blanket is in the roll. The blankets are unrolled at the time of installation and are positioned, in the case of the metal building, either across or along the purlin, with the facing exposed to provide the internal finish surface of the building.

The accurate tensioning and compression of the rolls during winding is important for several reasons. If proper tension is not provided as the rolls are formed, the facing and insulating material are not properly positioned while the adhesive sets and the facing tends to be wrinkled when the blanket is unrolled. In buildings in which the facing is exposed, wrinkles cause an unattractive appearance. In some instances, wrinkles can also cause a lack of continuity of the vapor barrier.

Also, the mats are compacted or compressed to some extent during the winding process. Upon unrolling at installation, the mat tends to spring back. For a particular mat, the resistance to heat transfer, commonly referred to as its "R factor," is determined to a considerable extent by the final density. If a given mat is wound too tightly, it will not, in some instances, spring back to its optimum density and will then not provide its optimum R factor. Therefore, it is desirable to control the winding compression, and in turn the density of the rolls, so that the installed blanket will have the optimum density and provide its optimum insulation value.

It is also desirable in many instances to wind the blanket as tightly as possible consistent with the above requirements of smooth facing and proper insulation factors so that a given roll is as small as possible. Because insulation blankets are relatively light for a given volume, the cost of shipment and storage is determined primarily on the basis of the volume of the roll. Consequently, a relatively tightly wound roll requires less storage and shipping space and reduces the related cost when compared to a bulky, loosely wound roll.

In the prior art, tension control devices have been provided. However, such devices have not, in most cases, provided as much accuracy in maintaining tension and ease of adjusting tension as is desirable.

SUMMARY OF THE INVENTION

In accordance with the present invention, a novel and improved adjustable tension and compression winding apparatus is provided for use in the lamination of insulation blankets or the like. Such apparatus is provided with accurate tension control so that the tension and density of each roll are uniformly maintained at the desired values. Further, the apparatus is easily adjusted so that the tension and compression can be changed when winding blankets of different characteristics so as to provide the desired tension and compression for the particular blanket being produced at a particular time.

The illustrated tensioning and compression apparatus provides a tensioning and compression roll which is vertically movable on a support frame. A pneumatic cylinder is connected to the roll to provide a force on the roll that is adjusted to substantially any desired value. The cylinder is also operable to raise and lower the roll as required.

A pneumatic control system is provided to control the operation of the cylinder. In the illustrated embodiment, the control operates during winding to supply a positive controlled pressure to each end of the cylinder. The pressure is supplied to each end of the cylinder by individually and accurately controlled pilot-operated regulators. The output force of the cylinder is a function of the difference in pressure or differential pressure between the two ends of the cylinder. Each of the pressures applied to the cylinder is separately and accurately controlled and is adjustable to permit the selection of virtually any desired differential pressure. Therefore, substantially any desired output force of the cylinder can be obtained. Further, the use of differentials between the positive pressures results in a smoother and more accurate operation of the cylinder.

The control circuit is also arranged so that the cylinder can be operated to raise and lower the tension roll.

In accordance with one embodiment, the cylinder applies a constant force to the tension roll during the entire operation of winding the insulation blanket. In accordance with another embodiment, the force is changed in a programmed manner during the winding of the roll to compensate for variations in the diameter as the roll is being wound.

Because the tension and compression roll force applied by the roll to a blanket being rolled is accurately controlled, an improved blanket structure is produced in which smooth facing is obtained along with optimum insulation factors. Further, the rolls can be consistently produced with the smallest size which is compatible with the production of a smooth facing and proper insulation factors to reduce the cost of storage and shipment.

These and other aspects of this invention are described in the following description and drawings.

DETAILED DESCRIPTION OF DRAWINGS

Figure 1:
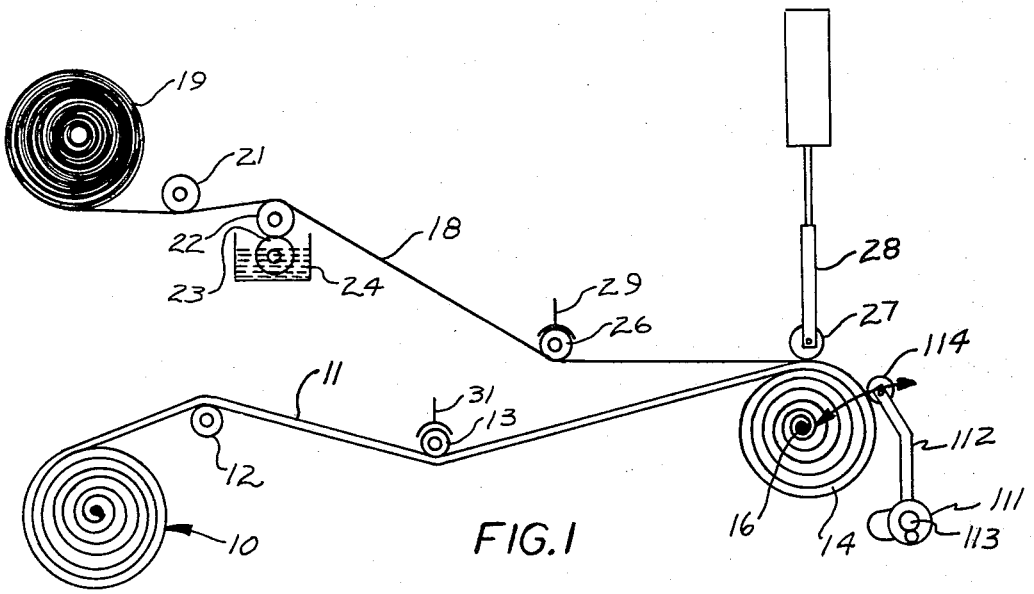
FIG. 1 is a schematic view of a laminating machine incorporating a winder and tensioning apparatus in accordance with this invention.
Figure 2:
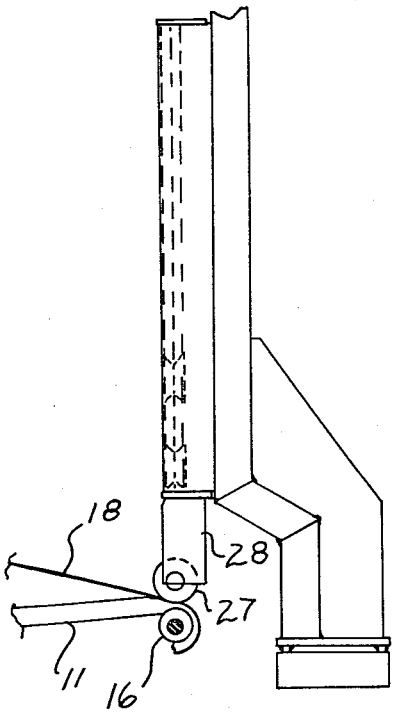
FIG. 2 is a fragmentary side elevation of the winding and tensioning apparatus at the beginning of a winding operation.
Figure 3:
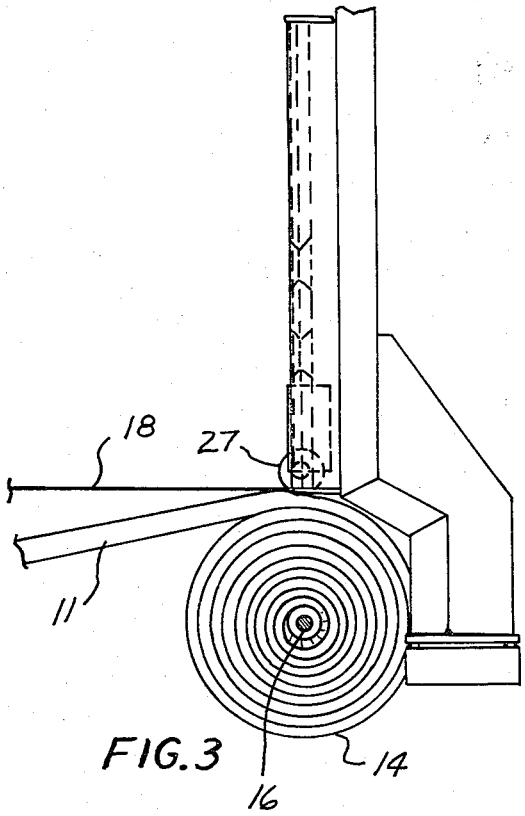
FIG. 3 is a fragmentary side elevation similar to FIG. 2, but illustrating the apparatus after the roll is partially completed.

FIG. 1 schematically illustrates a winding incorporating the present invention. In such machine, a supply roll as insulating material 10 is supported in any suitable manner and is arranged so that the insulating material 11 being fed into the laminating machine passes over a pair of guide rolls 12 and 13 and into a coil 14 supported and wound around a power-driven roll 16.

Facing 18 feeds off a facing supply roll 19 and under a first guide roll 21. From the guide roll 21, the facing passes over a transfer roll 22 which engages the upper side of a pickup roll 23. The pickup roll 23 extends into a reservoir 24 of adhesive. The rolls 23 and 24 operate to transfer a control layer of adhesive to one side of the facings. From the transfer roll 23, the facing 18 passes under a tensioning guide roll 26 and onto the coil 14, where it engages one face of the strip of insulating material 11 as it is wound onto the coil by the rotation of the power-driven roll 16. A compression and tensioning roll 27, which is journaled on a roll carriage 28, engages the side of the facing opposite the strip of insulation 11 and exerts a controlled force of insulation as it is wound onto the coil 14.

An adjustable drag brake 29 engages the roll 26 to adjustably control the tension of the facing as it moves to the coil 14. A similar adjustable drag brake 31 controls the rotation of the roll 13 and again adjustably controls the tension in the insulating material 11 as it reaches the coil 14. These two drag brakes permit the individual adjustment of the tension in the facing and in the insulating material being supplied to the coil 14, and, in cooperation with the tensioning and compression provided by the roll 27, ensure that the insulation and facing are properly tensioned in the coil 14.

Since the facing and insulating material are coiled immediately after the adhesive is applied to the facing, the adhesive is not set as the coil is being produced, but sets during the storage and transportation of the laminated coil to the place in which it will be installed. Since the setting of the adhesive occurs while the facing and insulating material are in the coiled form, and since the laminated blanket is installed in the flat form, the proper tensioning of the two strips is essential to the proper production of the finished product. For example, if the relative tension and compression facing and insulation mat are not properly maintained, the facing will become wrinkled when the blanket is uncoiled. On the other hand, if the facing is too tight compared to the insulating material, the blanket will not properly lie flat.

Since the insulating material is a loose mat of glass fibers, the insulating material is quite compressible. When the blanket is unrolled, such material springs back to some extent. The compression of the mat within the coil 14 should not be excessive, since the amount the blanket springs back is a function of the amount of compression within the coil and if excessive compression has occurred, there will be a tendency for the finished blanket to be overcompressed and to not provide optimum resistance to heat transfer. On the other hand, if the blanket is too loosely wrapped during its lamination, the finished installed blanket can again provide less than optimum resistance to heat transfer and the coil is unnecessarily large, requiring excessive storage and shipment volume. Since insulating blankets are relatively light for a given volume, the cost of shipping and storage is a function of the volume of the coil and not the weight. Therefore, it is desirable to provide the maximum compression of the insulating material within the coil 14 which is consistent with maintaining optimum installed insulation ratings, such as R ratings, while ensuring that the total size of the coil is not any larger than necessary.

Figure 4:
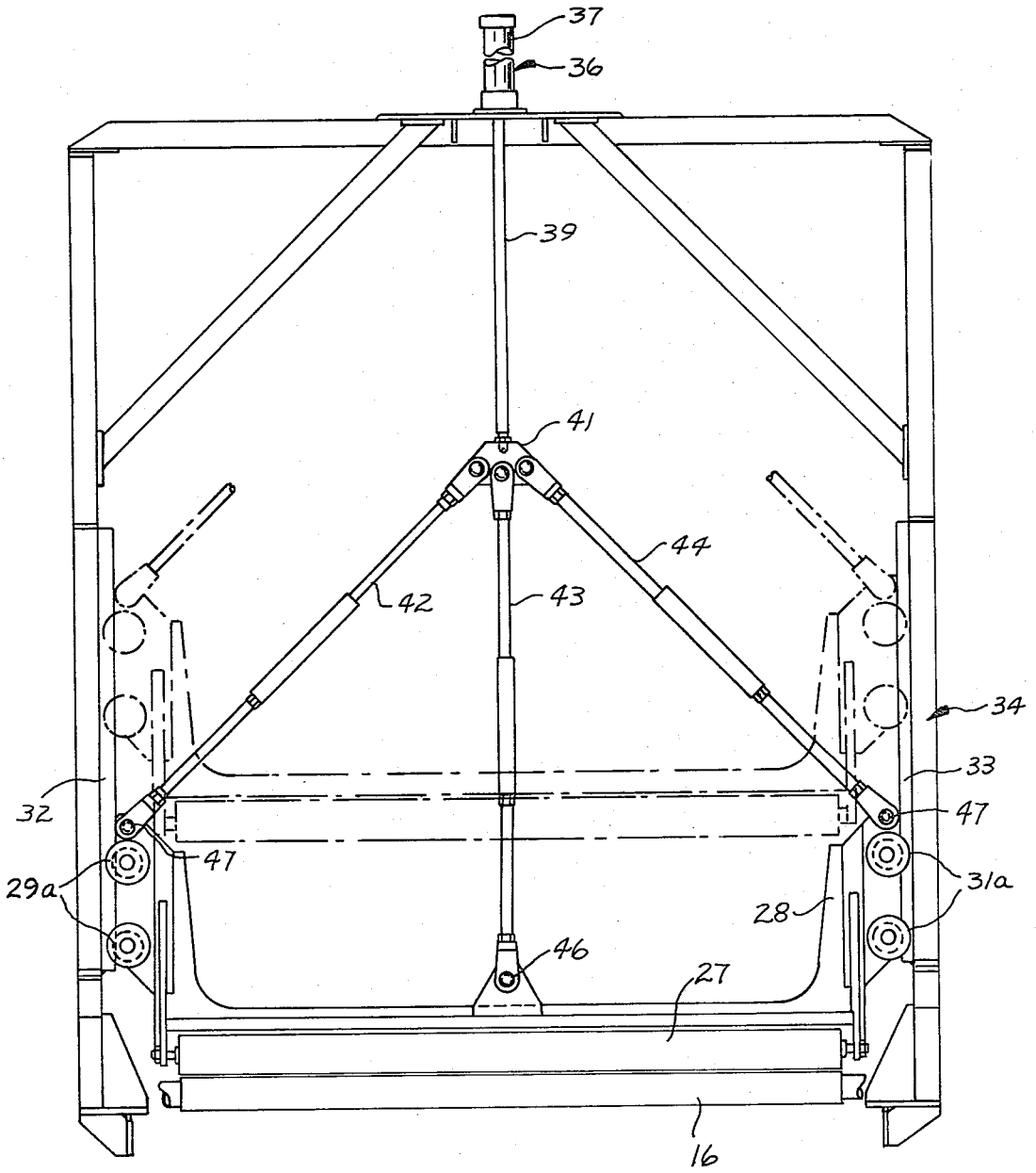
FIG. 4 is a front elevation of the winding apparatus.
Figure 5:
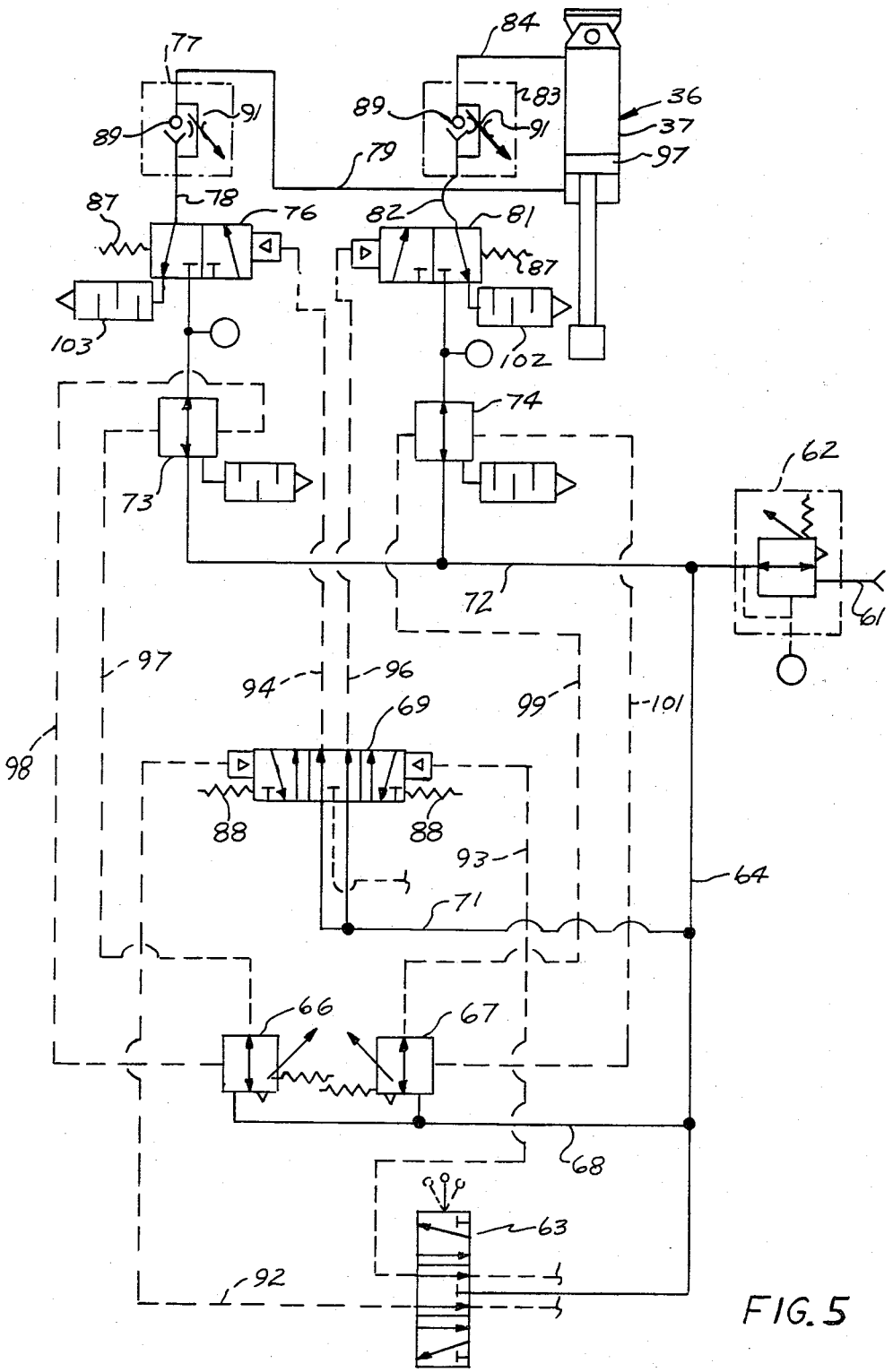
FIG. 5 is a diagram of the pneumatic control circuit.

In accordance with the present invention, the force exerted on the forming coil by the compression and tensioning roll 27 is controlled by an apparatus and pneumatic circuit best illustrated in FIGS. 4 and 5. Referring to FIG. 4, the roll 27 is journaled at its ends on a carriage 28 providing a spaced pair of rolls **29*a* and 31*a* on opposite sides of the carriage 28. Such rolls roll along associated guide rails 32 and 33, respectively, as the carriage is moved vertically up and down during the operation of the system. The rails 32 and 33 are in turn mounted in a vertical direction in a frame 34**.

An actuator 36 is provided with a cylinder 37 mounted on a crossbeam on the frame 34. A piston 39 of the actuator extends vertically down from the actuator and is connected at its end to a yoke 41. The yoke, in turn, is connected to the frame 34 by three adjustable support rods 42, 43, and 44. The rod 43 extends vertically down from the yoke and is connected to the center span of the carriage at 46. The two support rods 42 and 44 extend diagonally from the yoke 41 and are connected at 47 to the two sides of the carriage 28 immediately above the adjacent guide rolls. With this structure, a single actuator is effectively connected to the carriage to support the carriage for vertical movement within the frame 34.

The force of the roll 27 is applied to the coil 14 as the coil is being formed on the roll 16 and is accurately controlled by a pneumatic control circuit illustrated in FIG. 5. Air under pressure is supplied at 61 through a first adjustable pressure regulator 62. The output of this regulator 62 is connected to a control panel-mounted, three-position manual control valve 63 through a pressure line 64. The output of the regulator 62 is also connected to a pair of control panel-mounted, adjustable pilot pressure regulators 66 and 67 through a pressure line 68. A third connection is provided between the supply regulator 62 and a three-position pressure-operated valve 69 through a pressure line 71. Another pressure line 72 connects the output of the regulator 62 to a pair of pilot-operated pressure regulators 73 and 74. The pilot-operated regulator 73 is connected to a two-position pressure-operated valve 76, which in turn is connected through pressure line 78 to a flow control valve 77, and through a pressure line 79, to the lower end of the cylinder 37 of the actuator 36.

The other pilot-operated regulator connects to a second two-position pressure-operated valve 81, and through such valve to the upper end of the cylinder 37 through pressure line 82, a flow control 83, and a pressure line 84.

The various valves are illustrated in FIG. 5 in their normal positions which they assume when the system is not pressurized. The valves 76 and 81 are at their off position and are maintained in such off position, unless pressurized, by associated springs 87. Similarly, the three-position valve 69 is maintained in its center position by the opposed springs 88 when no pressure is applied to the ends of the valve.

Each of the flow control valves 77 and 83 includes a backcheck valve 89 and an adjustable flow restriction 91. The backcheck valves are connected so that they open to by-pass the associated flow restrictor 91 when fluid is passing from the control circuit to the actuator 36, but close to cause flow through the associated restrictor when fluid is flowing from the actuator 36. The two adjustable flow restrictors 91 are adjusted to provide the desired rate of movement of the piston when the actuator 36 is operated to raise or lower the carriage.

The manual valve 63, when in the position illustrated, connects both ends of the valve 69 to atmosphere through control lines 92 and 93, illustrated by dotted lines in FIG. 5. In such condition, the valve 69 is maintained in its neutral position illustrated and pressure supplied by the regulator 62 passes through control lines 94 and 96 to the valves 76 and 81, respectively. Such pressure shifts both of the valves 76 and 81 to their operative position (from the unpressurized position illustrated in FIG. 5) connecting the output of the pilot-operated regulator 73 with the lower end of the cylinder 37 and the output pressure of the pilot-operated regulator 74 to the upper end of the cylinder 37. The output pressure of the regulator 73, however, is adjusted to be different from the output pressure of the pilot-operated regulator 74 so that a differential pressure exists across the piston head 97 having value required to produce the desired output force of the actuator 36.

The relationships between the output pressures of the two pilot-operated regulators are determined by the adjusted settings of the associated adjustable regulators 66 and 67. The output pressure of the adjustable regulator 66 is communicated to the pilot-operated regulator 73 through a control line 97, and a feedback sensing line 98 is connected between the two so that the pilot-operated regulator 73 accurately maintains an output pressure determined by the setting of the adjustable regulator 66. Similarly, the output pressure of the adjustable regulator 67 is communicated to the pilot regulator 74 by a control line 99 and a feedback sensing line 101 communicates back between the two so that the output pressure of the pilot-operated regulator 74 is accurately determined by the setting of the adjustable regulator 67. Preferably, the pilot-operated regulators 73 and 74 are located on the machine near the actuators 36 so that line losses are not appreciable. However, the adjustable regulators 66 and 67 which control the operation of the pilot-operated regulators are preferably mounted on the unit control panel where they are conveniently accessible to the machine operator.

There are three operating conditions provided for by the control circuit which are manually controlled by the machine operator. The first mode of operation involves operation of the actuator 36 to raise the roll 27. This is accomplished by shifting the valve 63 to its lowered position connecting the pressure line 64 to the control line 93 while continuing to connect the control line 92 to atmosphere exhaust. This pressurizes the right end of the valve 69, as viewed in FIG. 5, shifting it to the left. In such position, the control line 94 remains pressurized so that control pressure from the regulator 73 continues to be supplied to the lower end of the actuator. However, in such position of the valve 69, the control line 96 is connected to atmosphere so that the valve 81 returns to the illustrated position, connecting the line 82 through a muffler 102 to atmosphere.

In such condition, the output pressure of the pilot-operated regulator 73 maintains pressure on the lower side of the cylinder 37, while the upper side is connected to atmosphere through the flow control 73. The rate at which the piston 39 moves upwardly under such conditions is determined by the setting of the flow restrictor 91, since the backcheck valve 89 is closed under such condition.

The second mode of operation involves the powered extension of the actuator to lower the roller 27. This is accomplished by manual operation of the valve 63 to its raised position, in which the control line 92 is connected to the supply line 64 and the control line 93 is connected to atmosphere. In such position, pressure supplied to the left end of the valve 69 as viewed in FIG. 5 shifts the valve to the right, causing the control line 94 to be connected to atmosphere, while maintaining pressure in the line 96. As soon as the valve 69 connects the control line 94 to atmosphere, the valve 76 returns to the illustrated position under the influence of its associated spring 87, connecting the lower end of the cylinder 73 to atmosphere through a muffler 103. Here again, the associated flow control valve 77 operates to control the rate of extension of the actuator 36 by the adjustment of the flow restrictor 91.

The third mode of operation is the mode utilized during the operation of the machine to form a coil 14. In such mode, the manual valve 63 is in the illustrated position, in which both of the control lines 92 and 93 are connected to atmosphere and the valve 69 remains in the illustrated position. In such position of the valve 69, both of the control lines 94 and 96 are pressurized, and the two valves 76 and 81 are shifted to their operative position, connecting the output of the pilot-operated regulator 73 to the lower end of the cylinder 37 and the output of the pilot-operated regulator 74 to the upper end of the cylinder 37. In such operation, the two adjustable regulators 66 and 67 are adjusted to provide the differential pressure required to produce the desired force between the roll 27 and the coil 14 being formed.

For example, if a differential pressure of 5 psi is required to produce the desired force and the main supply regulator is adjusted to produce an output or control pressure in the line 64 of 80 psi, the adjustable regulator 66 could, for example, be adjusted so that the output pressure of its associated pilot-operated regulator 73 is 60 lbs. and the adjustable regulator 67 is then adjusted so that the output pressure of the pilot-operated regulator 74 is 55 psi. In such illustrative example, the pressure in the upper end of the cylinder 37 would be 60 psi and the pressure in the lower end of the cylinder 37 would be 55 psi. With such settings, 55 psi would be available to retract the actuator when powered raising of the roll 27 is required and 60 psi would be available for extension of the actuator when powered lowering of the roller is required.

It should be understood that in a typical actuator of the piston and cylinder type illustrated, the effective area beneath the piston heads 97 is less than the effective area above such piston head. Therefore, the output force of the actuator is a function of the pressure below the piston head times its effective area, which is in opposition to the downward force which is a function of the pressure above the piston head times its total area.

It should also be further understood that the weight of the carriage and roll is in a downward direction.

Therefore, in some instances, the coiling operation is performed with pressure in the upper end of the cylinder which is lower than the pressure in the lower end of the cylinder, or possibly equal thereto in a given instance.

With the control circuit, however, it is possible to establish substantially any desired output force output of the actuator 37, and in turn substantially any desired force on the compression roll 27.

Because the two ends of the cylinder 37 are both pressurized during the coiling operation, smoother operation and better control are obtained than if only one or the other ends of the cylinder is pressurized. Improved control is also accomplished because the two pilot-operated regulators are supplied with a controlled pressure from the regulator 62. Further, it is preferable to select the output pressures of the pilot-operated regulators to reasonably closely approach the pressure of the supply regulator 62 so that the pilot-operated regulators do not have to establish substantial changes in pressure during their operation. With such settings, greater operating accuracy is obtained.

With the circuit illustrated in FIG. 5, a uniform force is applied to the coil by the roll 27 as the coil builds and the roll merely rides up along the surface of the coil as the coiling operation continues.

In some instances, it is desirable to provide a system in which the force of the roll 27 is changed as the coil is formed. In such instances, a servo regulator 111 (illustrated in FIG. 1) is provided. Such regulator provides a control arm 112 pivoted for rotation about an axis 113 and providing a roller 114 engaging the surface of the coil as it is formed. As the coil increases in diameter, the control arm moves in a clockwise direction as illustrated in FIG. 1 to change the setting of the servo regulator 111. The effect of the rotation of the arm 112 is to change the output pressure produced by the servo regulator 111 in a manner which is related to the position of the arm. If, for example, the regulator is constructed so that the output pressure thereof increases as the arm moves to the right in a linear manner, and if it is desired to provide a system in which the force of the roll 27 on the coil increases as the coil builds, the servo regulator 111 is placed in the control circuit of FIG. 5 as a substitute for the regulator 67. In such instance, the output or control pressure of the regulator 111 supplied to the control line 99 would increase as the coil 14 increased in diameter, causing the output pressure of the pilot-operator regulator to increase and cause a pressure increase in the upper end of the cylinder 37, which is a function of the radius of the coil. In such embodiment, the force on the roll 27 increases as the coil increases. Conversely, if such a servo regulator 111 is used in a system in which the force on the roll 27 is required to be reduced as the coil 14 builds, the servo regulator would be exchanged for the adjustable regulator 66 in the circuit of FIG. 5.

In accordance with the present invention, accurate control of the force of the roller 27 on the coil as the coil is being formed is accomplished so that the amount of compression of the insulating material 11 is accurately controlled in the coil. It should be recognized that the force of the roller 27 also affects the tension in the roll to some extent, and the two drag brakes 29 and 31 are adjusted so that the tension in the facing is properly related to the tension in the insulating material, along with the compression in the two parts of the laminate being formed.

With the present invention, sufficient control is provided of the laminating and winding process to ensure that the facing will be smooth when the blanket is installed, the blanket will lie flat, the optimum insulating factors are achieved, and excessive roll sizes are eliminated.

Although the preferred embodiments of this invention have been shown and described, it should be understood that various modifications and rearrangements of the parts may be resorted to without departing from the scope of the invention as disclosed and claimed herein.

What is claimed is:

1. A tensioning and compression apparatus for use in the production of rolls of faced insulation blankets, comprising a frame, a powered roll journaled on said frame for rotation about a first axis and around which a blanket is coiled, a tension and compression roll supported on said frame for movement toward and away from said powered roll and journaled for rotation about a second axis substantially parallel to said first axis, a piston and cylinder actuator mounted on said frame and connected to said tension and compression roll operable to apply a force to said tension and compression roll as a blanket is being coiled on said powered roll, said actuator producing a controlled force of engagement between said tension and compression roll and the outer surface of the blanket being coiled on said powered roll, and pressure control means connected to supply a separately controlled positive pressure to each of the two ends of said cylinder, said force of engagement being a function of the relationship between the positive pressures being applied to said cylinder ends.

2. A tensioning and compression apparatus as set forth in claim 1, wherein said control means is selectively operable to cause said actuator to move away from said powered roll, toward said powered roll and to apply a controlled force tending to move said tension and compression roll toward said powered roll.

3. A tensioning and compression apparatus as set forth in claim 2, wherein said control means operates to maintain a substantially constant force as a blanket is being coiled.

4. A tensioning and compression apparatus as set forth in claim 2, wherein said pressure control means operates to change the force of said tension and compression roll on said blanket being coiled as a direct function of the radius of said coil.

5. A tensioning and compression apparatus as set forth in claim 1, wherein said control means operates to maintain a substantially constant force on a blanket being coiled.

6. A tensioning and compression apparatus as set forth in claim 1, wherein said pressure control means operates to change the force of said tensioning and compression roll on said blanket being coiled as a function of the radius of said coil.

7. A tensioning and compression apparatus as set forth in claim 1, wherein said control circuit provides first pressure regulating means connected to one end of said cylinder and second pressure regulating means connected to the other end of said cylinder, said first and second pressure regulating means being separately adjustable.

8. A tensioning and compression apparatus as set forth in claim 7, wherein one pressure regulating means includes a sensor to determine the size of a coil being produced and operable to change said relationship of positive pressures as a function of the size of a coil being formed.

9. A machine for laminating and coiling insulating blankets having a mat of insulation and a facing comprising a powered roll around which a blanket is rolled in a coil, first tension means operable to adjustably control the tension in the facing feeding to said coil, second tension means operable to adjustably control the tension in said mat of insulation feeding to said coil, and a tension and compression roll engaging said blanket as it is positioned on said coil, and power means controlling the force of engagement between said tension and compression roll and said coil, said power means being adjustable to change said force of engagement.

10. A machine as set forth in claim 9, wherein said power means includes a pneumatic piston and cylinder actuator, and first and second pressure control means respectively operable to supply controlled air pressure to the first and second ends of said actuator.

11. A machine as set forth in claim 10, wherein said pressure control means are operable to simultaneously supply air pressure to said actuator at related and positive pressures.

12. A machine as set forth in claim 11, wherein said related positive pressures have different positive values.

13. A machine as set forth in claim 12, wherein said pressure control means are separately adjustable and are supplied from a common source of pressure, said first and second pressure control means being adjusted to supply pressure having a value greater than one-half the pressure of said source of pressure.

14. A machine as set forth in claim 13, wherein manual control means are provided to connect one end of said cylinder to atmosphere while the other end remains connected to its associated pressure control means.

15. A machine as set forth in claim 13, wherein one of said pressure control means provides a sensor operable to engage the surface of said coil being formed and determine the radius thereof, said one of said pressure control means operating to change the pressure supplied thereby to said actuator as a function of the radius of said coil being formed.

* * * * *